US012324962B2

(12) United States Patent
Zoffoli et al.

(10) Patent No.: US 12,324,962 B2
(45) Date of Patent: Jun. 10, 2025

(54) METHOD FOR ESTIMATING A MAXIMUM POWER VALUE GENERATABLE BY A USER DURING A RESISTANCE TRAINING EXERCISE ON AN EXERCISE MACHINE AND EXERCISE MACHINE ABLE TO IMPLEMENT SAID METHOD

(71) Applicant: TECHNOGYM S.P.A., Forli'-Cesena (IT)

(72) Inventors: Luca Zoffoli, Forli'-Cesena (IT); Silvano Zanuso, Forli'-Cesena (IT)

(73) Assignee: TECHNOGYM S.P.A., Forli'-Cesena (IT)

( * ) Notice: Subject to any disclaimer, the term of this patent is extended or adjusted under 35 U.S.C. 154(b) by 282 days.

(21) Appl. No.: 17/969,075

(22) Filed: Oct. 19, 2022

(65) Prior Publication Data

US 2023/0124164 A1 Apr. 20, 2023

(30) Foreign Application Priority Data

Oct. 19, 2021 (IT) ..... 102021000026720

(51) Int. Cl.
*A63B 24/00* (2006.01)

(52) U.S. Cl.
CPC .. *A63B 24/0087* (2013.01); *A63B 2024/0093* (2013.01)

(58) Field of Classification Search
CPC ..... A63B 22/02–04; A63B 69/0028–0035
See application file for complete search history.

(56) References Cited

U.S. PATENT DOCUMENTS

| | | | | |
|---|---|---|---|---|
| 10,814,172 | B1 | 10/2020 | Ilfrey et al. | |
| 2003/0013584 | A1* | 1/2003 | Harney | A63B 22/02 482/8 |
| 2011/0077127 | A1* | 3/2011 | Ishii | A63B 21/0058 482/8 |
| 2014/0113261 | A1 | 4/2014 | Akiba | |
| 2018/0001134 | A1* | 1/2018 | Bayerlein | A63B 22/02 |
| 2020/0179789 | A1* | 6/2020 | Fima | A63B 24/0087 |
| 2020/0330818 | A1* | 10/2020 | Thomas | A63B 21/062 |
| 2021/0023416 | A1* | 1/2021 | Yu | A61B 5/1126 |
| 2022/0040528 | A1* | 2/2022 | Manzke | A63B 22/02 |
| 2022/0362652 | A1* | 11/2022 | Del Monaco | A63B 22/0235 |

FOREIGN PATENT DOCUMENTS

EP 3 031 499 A1 6/2016

OTHER PUBLICATIONS

Italian Search Report for Italian Patent Application No. 102021000026720 dated Jun. 3, 2022, 8 pages.

* cited by examiner

*Primary Examiner* — Nyca T Nguyen
(74) *Attorney, Agent, or Firm* — Merchant & Gould P.C.

(57) ABSTRACT

A method for estimating a maximum power value generatable by a user during a resistance training exercise on an exercise machine includes executing at least three resistance training exercises. The push load to be set for the third execution of the resistance training exercise depends on the comparison of the last measured power peak value with the power peak values measured during the previous executions of the resistance training exercise.

9 Claims, 6 Drawing Sheets

METHOD FOR ESTIMATING A MAXIMUM POWER VALUE GENERATABLE BY A USER DURING A RESISTANCE TRAINING EXERCISE ON AN EXERCISE MACHINE AND EXERCISE MACHINE ABLE TO IMPLEMENT SAID METHOD

CROSS-REFERENCE TO RELATED APPLICATION

This application claims the benefit of Serial No. 102021000026720, filed 19 Oct. 2021 in Italy, and which application is incorporated herein by reference. To the extent appropriate, a claim of priority is made to the above disclosed application.

FIELD OF THE INVENTION

The present invention relates to the fitness sector, and in particular, to a method for estimating a maximum power value generatable by a user during a resistance training exercise on an exercise machine, and to an exercise machine able to implement said method.

TECHNOLOGICAL BACKGROUND OF THE INVENTION

Knowing the maximum power value generatable by a user during a resistance training exercise (e.g., a sled training exercise) on an exercise machine (e.g., a treadmill) is very important as it allows setting a suitable push load on the exercise machine for performing a set push training exercise in an optimal and safe manner, achieving the expected results in terms of performance and improvement of physical fitness and avoiding as much as possible excessive fatigue, risk of injury, and so on.

Nowadays, in order to know the maximum power value generatable by a user during a sled training exercise on an exercise machine, the user performs a test in which, using different push loads, he/she attempts to develop the maximum power, defined by the product between the overcome resistance vs. push load and the displacement speed.

The values calculated following the tests performed are compared with one another and the greater value is assigned to the user as an estimated maximum power value generatable by the user during a sled training exercise on an exercise machine.

However, this type of test still seems to be inaccurate and therefore not very reliable.

In light of this, there is a strong need to be able to estimate a maximum power value generatable by a user during a sled training exercise on an exercise machine that is as accurate and reliable as possible in order to set a push load value on the exercise machine that allows performing a set push training exercise in an optimal and safe manner, increasing the possibility of achieving the expected results in terms of performance and improvement of physical fitness and avoiding as much as possible excessive fatigue, risk of injury, and so on.

SUMMARY

It is the object of the present invention to devise and provide a method for estimating a maximum power value generatable by a user during a resistance training exercise on an exercise machine that is as accurate and reliable as possible in order to set a push load value on the exercise machine that allows performing a set push training exercise in an optimal and safe manner, increasing the possibility of achieving the expected results in terms of performance and improvement of physical fitness and reducing as much as possible the excessive fatigue, the risk of injury, and so on.

Such an object is achieved by a method for estimating a maximum power value generatable by a user during a resistance training exercise on an exercise machine, comprising:

- performing, by the user, a resistance training exercise on an exercise machine pushing a first push load for a set distance, the value of which corresponds to a set first percentage of the body weight of the user;
- determining, by a data processing unit, a first value of power peak generated by the user during the performance of the resistance training exercise by pushing the first push load for the set distance;
- performing, by the user, the resistance training exercise on the exercise machine pushing a second push load for a set distance, the value of which corresponds to a set second percentage of the body weight of the user;
- determining, by a data processing unit, a second value of power peak generated by the user during the performance of the resistance training exercise by pushing the second push load for the set distance;
- comparing, by the data processing unit, the first value of power peak measured with the second value of peak power measured;
- determining, by the data processing unit, a value of a third push load, the value of which corresponds to a set third percent of the body weight of the user, based on the comparison of the first value of power peak measured with the second value of peak power measured;
- performing, by the user, the resistance training exercise on the exercise machine pushing the third push load equal to the determined value for the set distance;
- determining, by the data processing unit, a third value of power peak generated by the user during the performance of the resistance training exercise by pushing the third push load for the set distance;
- determining, by the data processing unit, a set maximum power value generatable by a user during a resistance training exercise on the exercise machine based on the determined first value of power peak, the determined second value of power peak, and the determined third value of power peak.

The present invention also relates to an exercise machine able to implement said method, and to a system comprising such an exercise machine, able to implement said method.

BRIEF DESCRIPTION OF THE DRAWINGS

Further features and advantages of the method, the exercise machine and the system according to the invention will become apparent from the following description of preferred embodiments, given by way of indicative, non-limiting example, with reference to the accompanying drawings, in which.

It should be noted that, in the aforesaid figures, equivalent or similar elements are indicated by the same numeric and/or alphanumeric reference.

DETAILED DESCRIPTION

Figure 1:
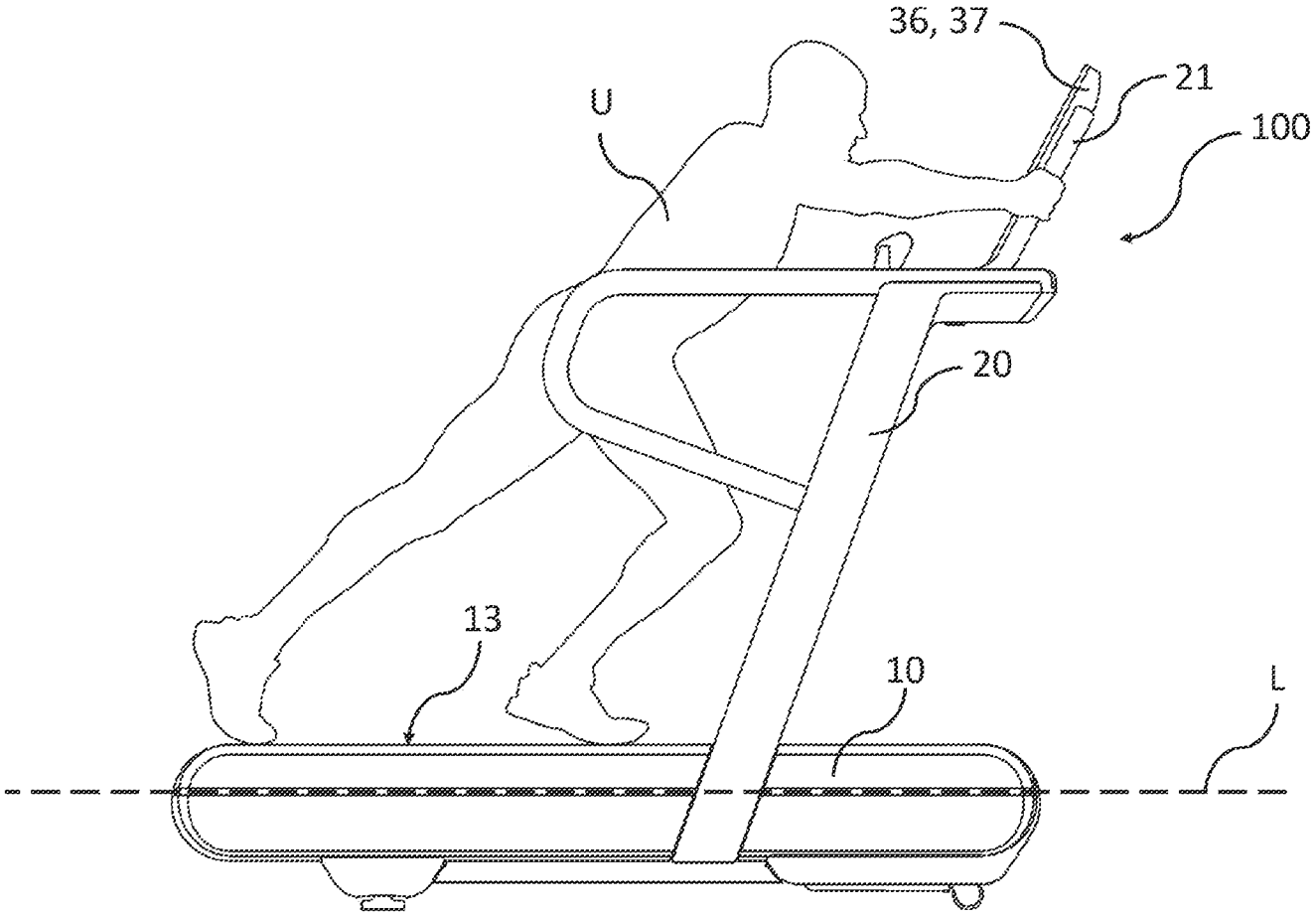
FIG. 1 shows a side view of an exercise machine usable in a method for estimating a maximum power value generatable by a user during a resistance training exercise on an exercise machine, in accordance with the present invention, with a user intent on performing a sled training exercise on such an exercise machine.

With reference to FIGS. 1-4, reference numeral 100 indicates, as a whole, an exercise machine usable in the method for estimating a maximum power value generatable by a user during a resistance training exercise on an exercise machine, in accordance with the present invention.

"Resistance training exercise" or "passive mode training exercise" means an exercise in which a user opposes the resistance of a push load such as, for example, both a push training exercise (e.g., a sled training exercise) and a pull training exercise consisting in providing a hook for the user, for example at the waist level, with the same execution and control modes as the push training exercise.

It should be noted that "exercise machine" means any exercise machine usable by the user to perform a resistance training exercise such as, for example, a flat treadmill, a curved treadmill, an elliptical machine, a bike or exercise bike, and so on.

In the example in the figures, the exercise machine 100 is a flat treadmill.

Figure 2:
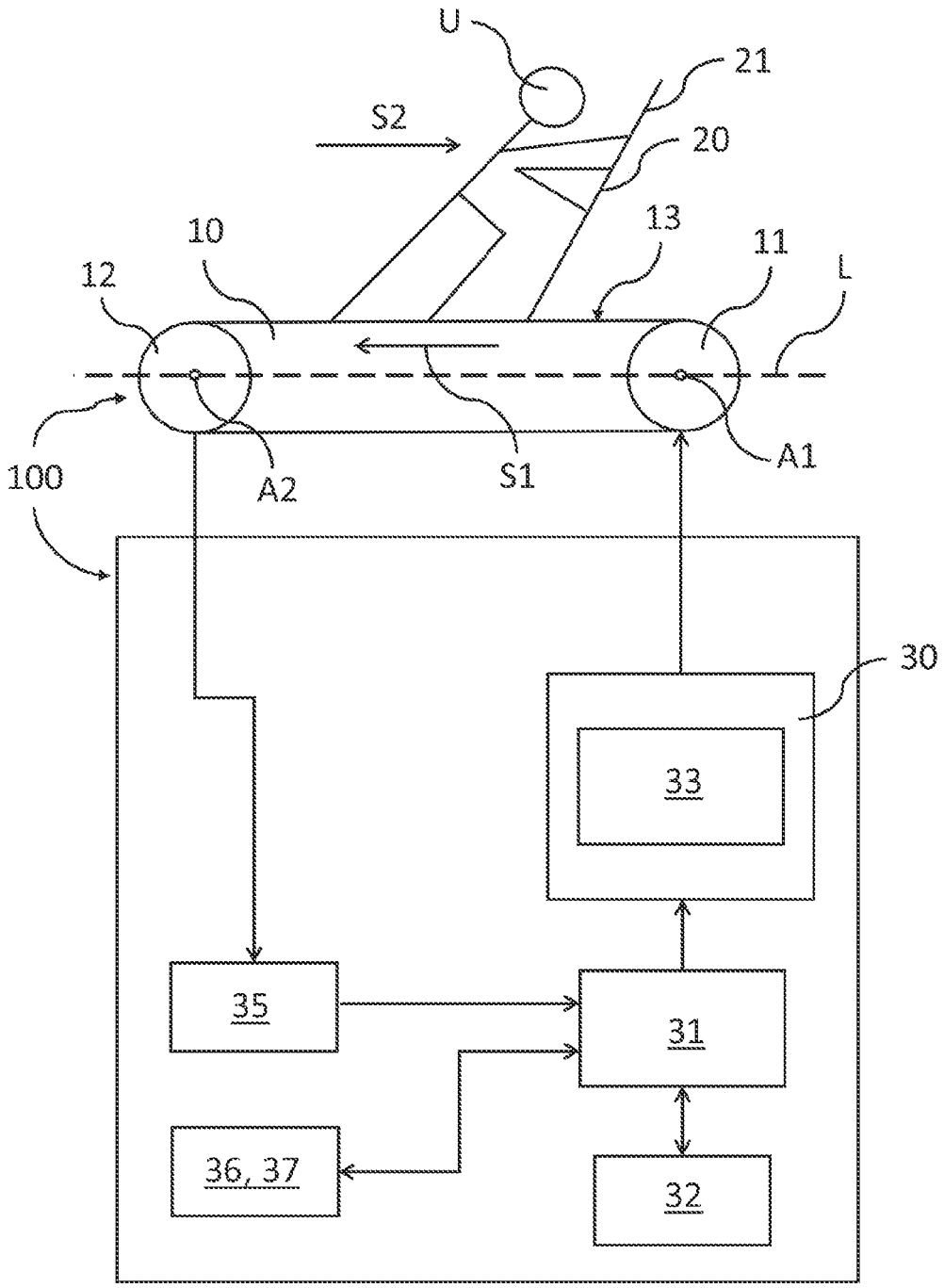
FIGS. 2, 3 and 4 show, respectively and by a block diagram, exercise machines usable in a method for estimating a maximum power value generatable by a user during a resistance training exercise on an exercise machine, according to respective and different embodiments.
Figure 3:
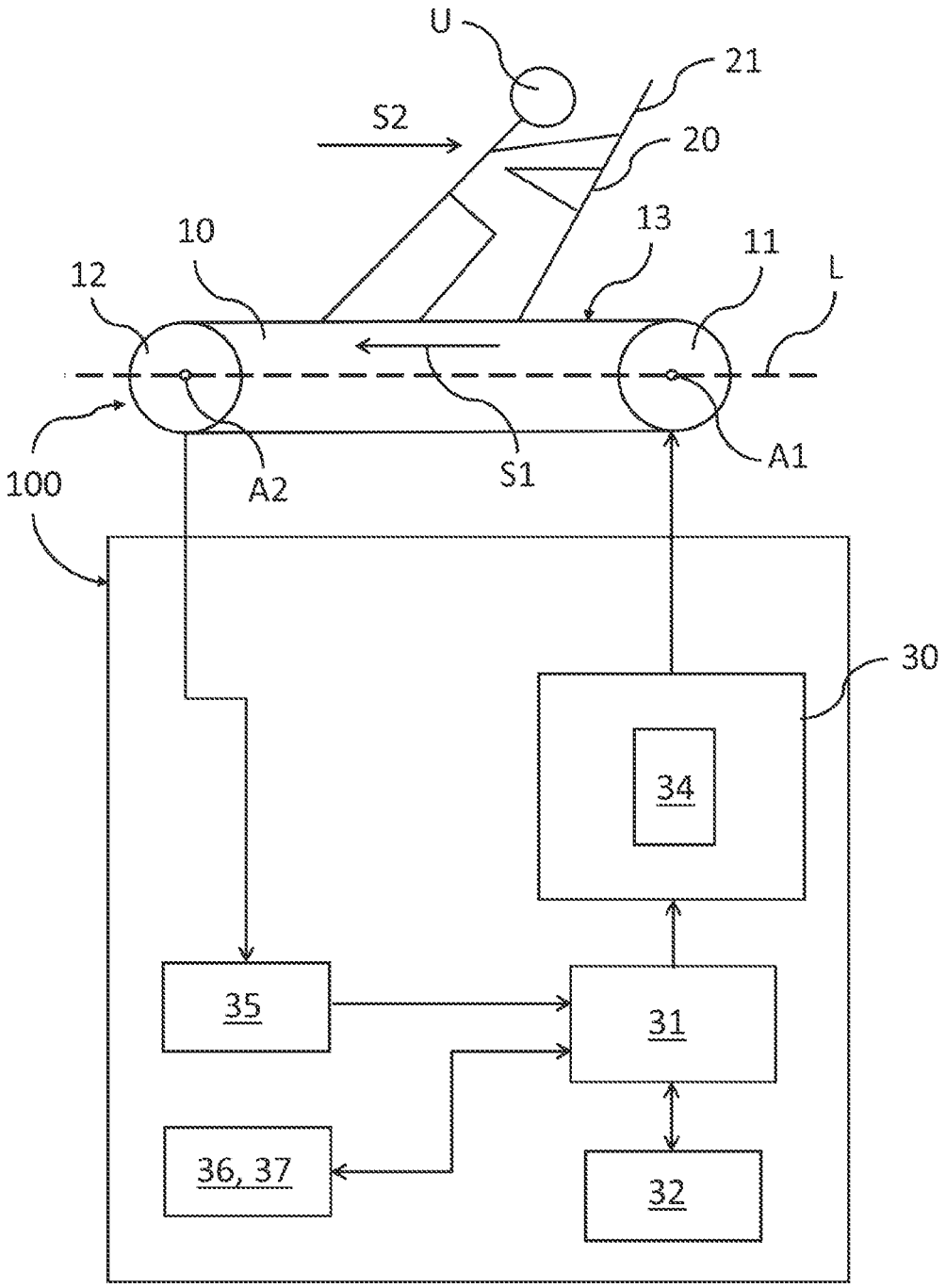
Figure 4:
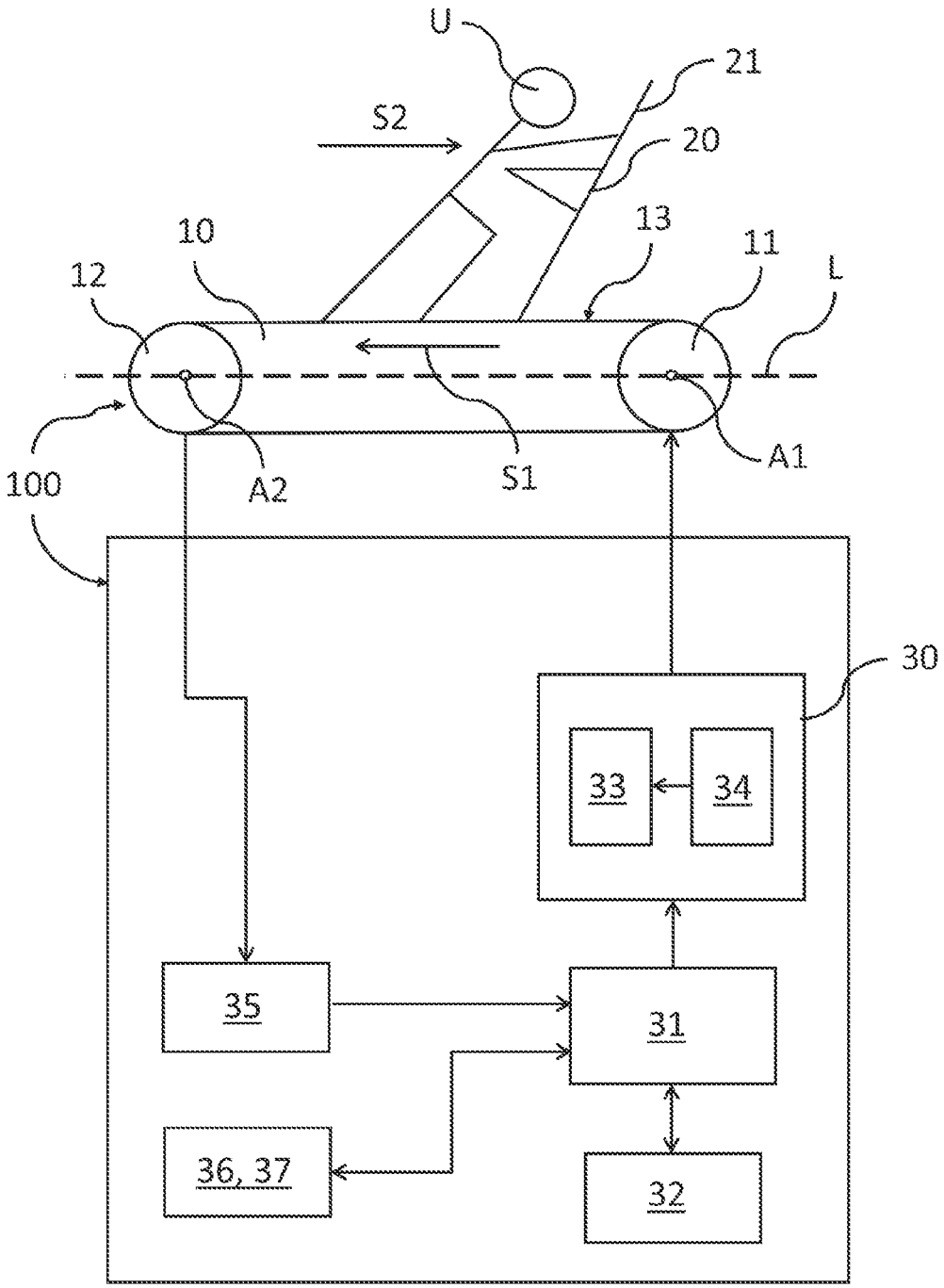

It should be noted that, in particular in FIGS. 2-4, only some components of the exercise machine 100 are shown, simply representing them by means of a block diagram in order to better highlight the technical features of the exercise machine 100 and its components, which are essential and important for the present invention.

With reference to any one of FIGS. 1-4, the exercise machine 100 comprises a base 10 extending along a longitudinal axis L, indicated in the figures by a dashed line.

The base 10 comprises a first rotating element 11 and a second rotating element 12 adapted to rotate about respective rotation axes (first rotation axis A1 for the first roller 11, second rotation axis A2 for the second roller 12) transverse to the longitudinal axis L of the base 10 of the exercise machine 100 (FIGS. 2-4).

It should be noted that the first rotating element 11 is arranged at a first end of the base 10 while the second rotating element 12 is arranged at a second end of the base 10, which is located, along the longitudinal axis L of the base 10, in the opposite position with respect to the position in which the first end is located.

The base 10 further comprises a physical exercise surface 13 operatively connected to the first rotating element 11 and the second rotating element 12.

For the purposes of the present description, "physical exercise surface" means the rotatable surface of the exercise machine 100, for example the treadmill, on which, by placing his/her feet or lower limbs in general, a user U (diagrammatically depicted in FIGS. 1-3) can perform a physical exercise such as running, walking, push training exercises, pull training exercises, for example, or any other type of physical exercise that the treadmill 100 allows to perform.

Moreover, it should be noted that the term "rotating element" means any mechanical element adapted to rotate about a respective rotation axis so as to impart a rotation to the "physical exercise surface" operatively associated with one or more of these rotating elements.

The type of rotating elements, some examples of which will be described below, depends on the type of physical exercise surface to be rotated.

In greater detail, the rotation of the first rotating element 11 also drives the physical exercise surface 13 and the second rotating element 12 into rotation. Quite similarly, the rotation of the second rotating element 12 drives the first rotating element 11 and the physical exercise surface 13 into rotation.

When the physical exercise surface 13 is moving, the advancement direction of the physical exercise surface 13, indicated in FIGS. 1-3 by the reference symbol S1 (for example, from right to left), is opposite to the advancement direction of the user U on the physical exercise surface 13, indicated in FIG. 1 by the reference symbol S2 (for example, from left to right).

In accordance with an embodiment, shown in FIGS. 1-4, the physical exercise surface 13 has a lateral profile substantially parallel to longitudinal axis L of the base 10.

Therefore, in this embodiment, the exercise machine 100 is a flat treadmill.

In accordance with a further embodiment, alternative to the previous one and not shown in the figures, the physical exercise surface 13 has a lateral profile substantially curved with respect to longitudinal axis L of the base 10.

Therefore, in this embodiment, the exercise machine 100 is a curved treadmill.

In accordance with an embodiment, in combination with any one of those just described, the physical exercise surface 13 comprises a belt or pad wound around the first rotating element 11 and the second rotating element 12, and a support deck (not shown in the figures), arranged between the first rotating element 11 and the second rotating element 12 along the longitudinal axis L of the base 10, on which the belt or pad runs, defining the physical exercise surface 13.

In this embodiment, the first rotating element 11 and the second rotating element 12 comprise two respective rollers, each rotatably coupled to the base 10 of the exercise machine 100 at the first and second ends of the base 10, to which the belt or pad is connected.

In accordance with a further embodiment (not shown in the figures), the physical exercise surface 13 comprises a plurality of strips transverse to the longitudinal axis L of the base 10.

In this embodiment, both the first rotating element 11 and the second rotating element 12 comprise two respective pulleys arranged close to the lateral portions of the base 10, transversely to the longitudinal axis L of the base 10, adapted to support the plurality of strips at the lateral edges of each strip.

In other words, in this further embodiment, the physical exercise surface 13 has a shutter configuration.

In particular, this shutter configuration is applied to both rotating pads with a physical exercise surface 13 having a lateral profile substantially parallel to the longitudinal axis L of the base 10 (flat treadmill) and rotating pads with a physical exercise surface 13 with curved lateral profile (curved treadmill).

Generally returning to the exercise machine 100 in FIGS. 1-4, the exercise machine 100 further comprises a frame 20 extending substantially in a vertical direction with respect to the base 10 having a shape so as to allow the user U to perform sled training exercises on the physical exercise surface 13.

The frame 20 is a combination of uprights and tubular elements operatively connected to one another and distributed so as to define a support structure substantially surrounding the user U when he/she is on the physical exercise surface 13.

Such a support structure comprises one or more supports for the user U, for example one or more bars, handles, grab bars, backrest or dedicated support for his/her torso or shoulders, and possibly also one or more hooks for pulling (not shown in the figures).

In particular, for performing a sled training exercise, such as that shown in FIG. 1, for example, the frame 20 comprises a pair of vertical uprights 21 (only one of which can be seen in the figures) that the user U can hold when pushing with his/her feet on the physical exercise surface 103.

It should be noted that any hooks for pulling, alternatively or in combination with those present on the frame 20 of the exercise machine 100, can be outside the exercise machine 100, for example distributed on an outer structure (e.g., an upright) positioned close to the exercise machine 100 or on a wall near which the exercise machine 100 is positioned.

Generally returning to the embodiment in FIGS. 1-4, the exercise machine 100 further comprises an actuation device 30 of the physical exercise surface 13 operatively associated with at least one of said first rotating element 11 and second rotating element 12.

The actuation device 30 of the physical exercise surface 13 will also simply be referred to as the actuation device below.

It should be noted that "actuation" means any action that can be performed on the physical exercise surface 13 such as to condition the rotation thereof, i.e., operation, speed increase or decrease, braking, and so on.

The actuation device 30 comprises at least one element (for example of electric, magnetic or electromagnetic type), operatively associated with the base 10 of the exercise machine 100 in a rotatable manner.

The actuation device 30 is operatively associated with at least one of the first rotating element 11 and the second rotating element 12 so that a rotation of the first rotating element 11 or the second rotating element 12 corresponds to a rotation of the actuation device 30, and conversely a rotation of the actuation device 30 corresponds to a rotation of the first rotating element 11 or the second rotating element 12.

"Rotation of the actuation device" means the rotation of the at least one electric member (not shown in the figures) of the actuation device 14 operatively associated with the base 10 of the exercise machine 100 in a rotatable manner.

It should be noted that, in an embodiment, the actuation device 30 is operatively connected to at least one of the first rotating element 11 or the second rotating element 12 in a direct manner.

In accordance with a further embodiment, alternative to the previous one and not shown in the figures, the actuation device 30 is operatively connected to at least one of the first rotating element 11 or the second rotating element 12 by means of at least one respective transmission member.

In an embodiment, the actuation device 30 is configured to apply a braking action to at least one of the first rotating element 11 or the second rotating element 12 and therefore to the physical exercise surface 13.

In this embodiment, the exercise machine 100, for example the treadmill as shown in FIGS. 1-4, is configured to operate in a "passive" mode (for push or sled training exercises), in which the braking action control is enabled/activated.

Moreover, in a further embodiment in combination with the previous one, the actuation device 30 is configured to apply a driving action to at least one of the first rotating element 11 or the second rotating element 12 and therefore to the physical exercise surface 13.

In this embodiment, the exercise machine 100, for example the treadmill as shown in FIGS. 1-4, is configured to operate in an "active" mode (for traditional running/walking).

With general reference to FIGS. 2-4, in an embodiment, the exercise machine 100 further comprises a data processing unit 31, e.g., a microprocessor or microcontroller.

The data processing unit 31 is operatively connected to the actuation device 30.

The exercise machine 100 further comprises a memory unit 32, operatively connected to the data processing unit 31.

The memory unit 32 can be either inside or outside (as shown in FIGS. 2 and 3, for example) the data processing unit 31.

It should be noted that the memory unit 32 is configured to store one or more program codes executable by the data processing unit 31 for controlling the exercise machine 100 and in particular for controlling the actuation device 30, for the purpose of operating the physical exercise surface 13.

In greater detail, the data to be stored in the memory unit 32 comprise data on the operation of the actuation device 30, based on which the data processing unit 31 can control the actuation device 30, as will be reiterated below.

More generally, further data to be stored in the memory unit 32 of the exercise machine 100 are data on the training programs/algorithms based on which the processing unit 31 can control the actuation device 30.

In further embodiments, which will also be reiterated below, the memory unit 32 is configured to store one or more program codes executable by the data processing unit 31 to fully or partially carry out the method for estimating a maximum power value generatable by a user during a resistance training exercise on an exercise machine in accordance with the present invention.

Returning to the actuation device 30, in an embodiment shown in FIG. 2, the actuation device 31 comprises a motor 33, operatively associated with and controllable by the data processing unit 31.

In this embodiment, the motor 33 is configured to apply both the driving action and the braking action to at least one of the first rotating element 11 or the second rotating element 12, therefore to the physical exercise surface 13, based on commands received from the data processing unit 31.

In this embodiment, examples of motor can be the "brushless" electric motor, the asynchronous electric motor, the switched-reluctance electric motor, the DC electric motor, and so on.

Note that in this embodiment, the actuation device 30 is a device that transforms electrical energy into mechanical energy and vice versa.

In a further embodiment, alternative to the previous one and shown in FIG. 3, the actuation device 33 comprises a brake 34, operatively associated with and controllable by the data processing unit 31.

In this embodiment, the brake 34 is configured to apply the braking action to the physical exercise surface 13, based on commands received from the data processing unit 31.

Note that the braking action by the brake 34 on the physical exercise surface 13 is applied by acting on at least one of the first rotating element 11 or the second rotating element 12.

In this embodiment, examples of brake 34 can be a regenerative brake (e.g., a generator), a magnetic brake with permanent magnets, an eddy current brake, a mechanical friction brake, and so on.

In a further embodiment, alternative to the previous ones and shown in FIG. 4, the actuation device 30 comprises a motor 33 and a brake 34, both operatively associated with and controllable by the data processing unit 31.

In this embodiment, the processing unit 31 is configured to separately control the motor 33 and the brake 34.

In this embodiment, the motor 33 is configured to apply the driving action to the physical exercise surface 13 for operating the exercise machine in the "active" mode, based on respective commands received from the data processing unit 31, while the brake 34 is configured to apply the braking action to the physical exercise surface 13 for operating the exercise machine 100 in the "passive" mode, based on respective commands received from the data processing unit 31.

It should be noted that the motor 33 is adapted to apply the driving action to the physical exercise surface 13 by acting on at least one of the first rotating element 11 or the second rotating element 12.

On the other hand, it should be noted that the brake 34 is adapted to apply the braking action to the physical exercise surface 13 by acting on the motor 33.

In this embodiment:

- examples of motor 33 can be the "brushless" electric motor, the asynchronous electric motor, the switched-reluctance electric motor, the DC electric motor, and so on;
- examples of brake 34 can be a regenerative brake (e.g., a generator), a magnetic brake with permanent magnets, an eddy current brake, a mechanical friction brake, and so on.

Referring now to any one of the embodiments described above, reference is generally made below to the actuation device 30 again, regardless of the aforementioned embodiments, to be considered in combination or alternatively with one another.

If the actuation device 30 is configured to apply a braking action to the physical exercise surface 13 based on commands received from the data processing unit 31, it is understood that this braking action is applied by the motor 33 or brake 34.

Returning to FIGS. 2-4, for example, the exercise machine 100 further comprises at least one sensor 35 for detecting at least one first parameter representative of the interaction between the user U and the physical exercise surface 13, hereinafter simply referred to as at least one sensor 35.

For the purposes of the present description, "parameter representative of the interaction between the user and the physical exercise surface" means any detectable parameter on the exercise machine 100 (e.g., kinematic parameters such as the speed or acceleration of the physical exercise surface 13 or the rotational speed of at least one of the first rotating element 11 or the second rotating element 12 or of the actuation device 30, or dynamic parameters such as the braking torque of the actuation device 30 or of at least one of the first rotating element 11 or the second rotating element 12) or any detectable parameter on the user U (e.g., the heart rate) the variation of which is related to the interaction between the user U and the physical exercise surface 13 when using the exercise machine 100.

With reference to the term "torque" or "braking torque", it should be noted that "torque" or "braking torque" means, depending on the actuation device 30 used according to one of the embodiments in FIGS. 2-4, the braking torque applied by the motor 33 if the actuation device 30 preferably comprises only the motor 33 (FIG. 2) or the braking torque applied by the brake 34, if the actuation device 30 comprises only the brake 34 (FIG. 3) and if the actuation device 30 comprises both the motor 33 and the brake 34 (FIG. 4).

In the description below, reference will also be made simply to "torque", in any case always meaning the "braking torque" as defined above. The at least one sensor 35 comprises a sensor positioned and selected depending on the parameter that needs to be detected for controlling the braking action of the actuation device 30, by operating the motor 33 or the brake 34, in accordance with one or more embodiments, in combination or alternatively with one another.

In an embodiment, the at least one sensor 35 comprises a speed sensor for detecting kinematic parameters.

Examples of the speed sensor are: an encoder, an accelerometer, a gyroscope, a combination thereof or other technical equivalent.

In another embodiment, in combination or alternatively to the previous one, the at least one sensor 35 comprises a torque sensor for the detection of dynamic parameters.

Examples of the torque sensor are: a torque meter, one or more load cells, one or more strain gauges, a combination of these or other technical equivalent, and so on.

In further embodiments, more in detail, the at least one sensor 35 can also be one or more combinations of the sensors indicated above.

In accordance with an embodiment, in combination with any one of those described above, the data processing unit 31 is configured to control the actuation device 30 in torque to allow the user U to use the exercise machine 100 for performing a resistance training exercise, for example allowing the exercise machine 100 to be used with constant torque control.

For this purpose, in an embodiment, the data processing unit 30 is configured to monitor at least one first parameter representative of the interaction between the user U and the physical exercise surface 13, such as the advancement speed of the physical exercise surface 13 or the rotational speed of at least one of the first rotating element 11 or the second rotating element 12 or of the actuation device 30, for example.

Therefore, in this embodiment, the at least one sensor 35 is a speed sensor.

In this embodiment, the data processing unit 30 is configured to monitor at least one second parameter representative of the interaction between the user U and the physical exercise surface 13, for example the braking torque of the actuation device 30 or of at least one of the first rotating element 11 or the second rotating element 12.

In this embodiment, the data processing unit 31 is configured to control at least one electrical control parameter of the actuation device 30, for example the electric absorption current of the actuation device 30, based on the change in the advancement speed of the physical exercise surface 13 or the rotational speed of at least one of the first rotating element 11 or the second rotating element 12 or of the actuation device 30 detected by said at least one sensor 35 to keep the braking torque of the actuation device 30 or of at least one of the first rotating element 11 or the second rotating element 12 substantially equal to the set reference value of the braking torque.

"To control at least one electrical control parameter of the actuation device 30" means modulating the value of said at least one electrical control parameter of the actuation device 30 so that it is substantially kept equal to a reference value corresponding to a set reference value of the braking torque and to a range of values within which the advancement speed of the physical exercise surface 13 or the rotation speed of at least one of the first rotating element 11 or the second rotating element 12 or of the actuation device 30 detected by said at least one sensor 35 can vary.

In a second embodiment, alternative to the previous one but always relating to constant torque control, the data processing unit 30 is configured to monitor at least one first parameter representative of the interaction between the user U and the physical exercise surface 13, such as the braking torque of the actuation device 30 or of at least one of the first rotating element 11 or the second rotating element 12.

Therefore, in this embodiment, the at least one sensor 35 comprises a torque sensor.

In this embodiment, the data processing unit 31 is configured to control at least one electrical control parameter of the actuation device 30, for example the electric absorption current of the actuation device 30, based on the change in the braking torque of the actuation device 30 or of at least one of the first rotating element 11 or the second rotating element 12 detected by said at least one sensor 35 to keep the braking torque of the actuation device 30 or of at least one of the first rotating element 11 or the second rotating element 12 substantially equal to a set reference value of the braking torque.

"To control at least one electrical control parameter of the actuation device 30" means modulating the value of said at least one electrical control parameter of the actuation device 30 so that is substantially kept equal to a reference value corresponding to the set reference value of the braking torque to be kept constant.

Without prejudice to the foregoing, regardless of the sensor used (speed or torque sensor), in accordance with a further embodiment in which the actuation device 30 comprises the motor 33, the set reference value of the braking torque is equal to a reference function with a time-varying trend, in particular varying from a first reference value corresponding to a braking action applied by the motor 33 to a second reference value representative of the driving action of the motor 33.

In particular, the data processing unit 31 is configured to control said at least one electrical control parameter of the actuation device 105 to keep the braking torque substantially equal to the set first reference value, so as to oppose the motion of the user U on the physical exercise surface 13.

In an embodiment, in combination with any one of those described above, shown in FIGS. 1-4, the exercise machine 100 further comprises a user interface module 36 operatively connected to the data processing unit 31.

The user interface module 36 is configured to allow the user U to interact with the exercise machine 100 and possibly to provide information on the execution of the method for estimating a maximum power value generatable by a user during a resistance training exercise on an exercise machine.

In an embodiment, the user interface module 36 can be of the touchscreen type.

In a further embodiment, alternative to the previous one, the user interface module 36 can be a push-button keyboard.

In an embodiment, in combination with any one of those described above, shown in FIGS. 1-4, the exercise machine 100 further comprises a display module 37 operatively connected to the data processing unit 31.

The display module 37 is configured to show contents representative of a training program to the user, e.g., identification or authentication screen, initial menu screen for setting the workout, screen with parameters and/or graphics being updated while the exercise is performed, workout summary screen, and so on.

Moreover, the display module 37 is configured to show to the user the results obtained at the end of the execution of the method for estimating a maximum power value generatable by a user during a resistance training exercise on an exercise machine in accordance with the present invention.

In an embodiment, shown in FIGS. 1-4, in which the user interface module 36 is of the touchscreen type, the display module 37 can coincide with the user interface module 36 (see FIG. 1, for example).

Note that, in this embodiment, the display module 37 is also configured to show the user interface module 36 to the user, in addition to the representative contents of a training program and/or the results provided at the end of the method for estimating a maximum power value generatable by a user during a resistance training exercise on an exercise machine.

Figure 5:
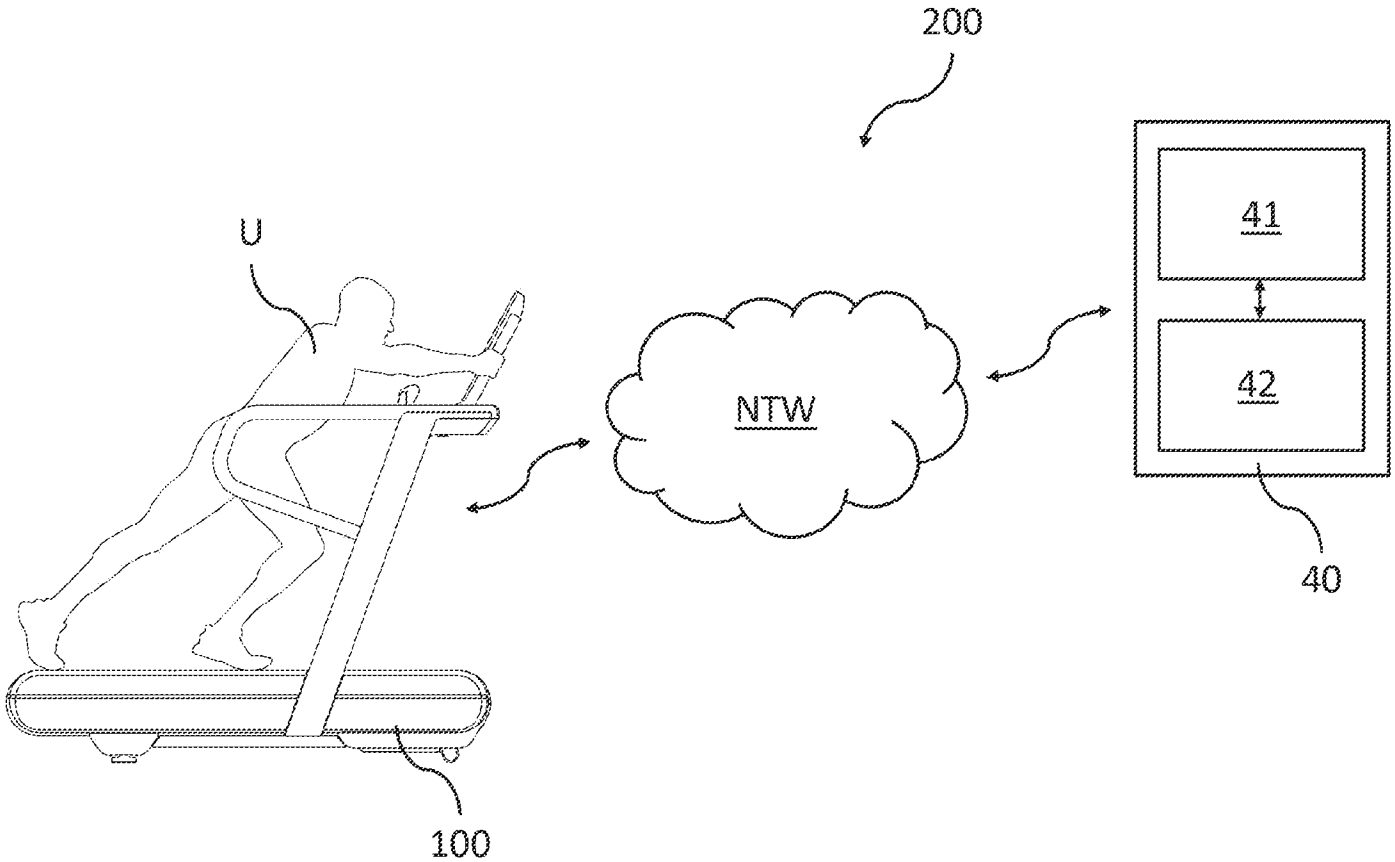
FIG. 5 shows, by a block diagram, a system adapted to implement a method for estimating a maximum power value generatable by a user during a sled training exercise on an exercise machine, according to an embodiment of the present invention.

Referring now to FIG. 5, a system 200 adapted to implement the method for estimating a maximum power value generatable by a user during a resistance training exercise on an exercise machine in accordance with the present invention is now described.

The system 200 comprises an exercise machine 100, described above in accordance with various embodiments, usable by a user U for performing a resistance training exercise, e.g. a sled training exercise.

The system 200 further comprises a remote electronic calculator 40, e.g., a remote server or cloud, operatively connected to the exercise machine 100 through a data communication network NTW, e.g., the Internet network.

The central electronic calculator 40 comprises a respective data processing unit 41, e.g., a microcontroller or microprocessor.

The central electronic calculator 40 further comprises a memory unit 42 operatively connected to the data processing unit 41.

The memory unit 42 can be inside (as diagrammatically shown in FIG. 5) or outside the data processing unit 41 (embodiment not shown in the figures).

The data processing unit 41, by uploading and executing one or more program codes, stored in the memory unit 42, is configured to communicate (transmit and receive) data with the exercise machine 100 when used by the user U (authentication, workout execution, exercise machine control, workout end management, data saving, and so on).

In further embodiments, which will also be reiterated below, the memory unit 42 is configured to store one or more program codes executable by the data processing unit 41 to fully or partially carry out the method for estimating a maximum power value generatable by a user during a resistance training exercise on an exercise machine in accordance with the present invention.

Also referring now to FIG. 6, a method 60 for estimating a maximum power value generatable by a user during a resistance training exercise on an exercise machine in accordance with the present invention is now described, also referred to as the estimation method 60 or simply method 60 below, according to an embodiment of the present invention.

The exercise machine 100, in accordance with various embodiments, has already been described above.

The estimation of a maximum power value generatable by a user during a resistance training exercise on an exercise machine that is as accurate and reliable as possible allows setting a push load value on the exercise machine 100 that allows the user U to perform a set push training exercise in an optimal and safe manner, increasing the possibility of achieving the expected results in terms of performance and improvement of physical fitness and reducing as much as possible the excessive fatigue, the risk of injury, and so on.

The push load value corresponds to the braking action that can be applied by the exercise machine 100 as opposed to the movement of the user U when performing a resistance training exercise, e.g. a sled training exercise.

In greater detail, if the exercise machine 100 is a treadmill, as in the embodiments in FIGS. 1-4, the push load value corresponds to the braking action that the actuation device 30 (by means of the motor 33 or the brake 34) applies to the physical exercise surface 103 (directly or indirectly by acting on at least one of the first rotating element 11 or the second rotating element 12) based on commands received from the data processing unit 31.

The method 60 comprises a symbolic step of starting ST.

The method 60 comprises a step of (a1) performing 61, by the user U, a resistance training exercise on an exercise machine 100 pushing a first push load WS1 over a set distance D1, the value of which corresponds to a set first percentage P1 of the body weight W1 of the user U.

For example, the exercise machine 100 is in the "passive" mode with a constant torque control, as described above.

The set distance is, for example, in the range of 10-20 meters, preferably 15 meters.

For example, the resistance training exercise is a sled training exercise like that diagrammatically shown in FIG. 1.

Over the whole set distance, the user U performs the sled training exercise with maximum effort and maximum push speed.

The first percentage P1 of the body weight W1 is 50%, for example.

The method 60 further comprises a step of (a2) determining 62, by a data processing unit 31 (41), a first value of power peak VP1 generated by the user U when performing the resistance training exercise by pushing the first push load WS1 over the set distance.

For example, in the case of a sled training exercise performed on a treadmill, once the first push load WS1 is set, the data processing unit 31 (41) knows the resistant torque (force) applied by the user to oppose the resistance represented by the first push load WS1.

Therefore, once the first push load WS1 is known and the advancement speed of the physical exercise surface 13 is determined (measured directly or determined from the rotation speed of at least one of the first rotating element 11 or the second rotating element 12 or of the actuation device 30, the latter measured by an encoder, for example), the first value of power peak VP1 is determined, by the data processing unit 31 (41), by multiplying the first push load value WS1 (set first percentage P1 of the body weight W1 of the user U) for the peak value of the determined advancement speed of the physical exercise surface 13. The peak value of the advancement speed of the physical exercise surface 13 is the maximum value among those determined (for example, at sampling time instants) during the sled training exercise.

The method 60 further comprises a step of (b1) performing 63, by the user U, the resistance training exercise on the exercise machine 100 by pushing a second push load WS2 over a set distance D1, the value of which corresponds to a set second percentage P2 of the body weight W1 of the user U.

Also in this case, for example, the exercise machine 100 is in the "passive" mode with a constant torque control, as described above.

The set distance D1 is, for example, in the range of 10-20 meters, preferably 15 meters.

Over the whole set distance, the user U performs the resistance training exercise with maximum effort and maximum push speed.

The second percentage P2 of the body weight W1 is 80%, for example.

Therefore, WS2=80% W1.

The method 60 comprises a step of (b2) determining 64, by a data processing unit 31 (41), a second value of power peak VP2 generated by the user U when performing the resistance training exercise by pushing the second push load WS2 over the set distance D1.

For example, again in the case of a sled training exercise performed on a treadmill, once the second push load WS2 is set, the data processing unit 31 (41) knows the resistant torque (force) applied by the user to oppose the resistance represented by the second push load WS2.

Therefore, once the second push load WS2 is known and the advancement speed of the physical exercise surface 13 is determined (measured directly or determined from the rotation speed of at least one of the first rotating element 11 or the second rotating element 12 or of the actuation device 30, the latter measured by an encoder, for example), the second value of power peak VP2 is determined, by the data processing unit 31 (41), by multiplying the second push load value WS2 (set second percentage P2 of the body weight W1 of the user U) for the peak value of the determined advancement speed of the physical exercise surface 13. The peak value of the advancement speed of the physical exercise surface 13 is the maximum value among those determined (for example, at sampling time instants) during the sled training exercise.

The method 60 comprises a step of (c1) comparing 65, by the data processing unit 31 (41), the first measured value of power peak VP1 with the second measured value of power peak VP2.

The method 60 comprises a step of (c2) determining 66, by the data processing unit 31 (41), a value of a third push load WS3, which value corresponds to a set third percentage P3 of the body weight W1 of the user U, based on the comparison of the first measured value of power peak VP1 with the second measured value of power peak VP2.

For example:

if VP2>VP1, WS3=100% W1.

if VP2<VP1, WS3=30% W1.

if VP2 is substantially equal to VP1, for example VP2±5% VP1, WS3=110% WS1.

The method 60 comprises a step of (c3) performing 67, by the user U, the resistance training exercise on the exercise machine 100 by pushing the third push load WS3 equal to the determined value over the set distance D1.

Also in this case, for example, the exercise machine 100 is in the "passive" mode with a constant torque control, as described above.

The set distance is, for example, in the range of 10-20 meters, preferably 15 meters.

Over the whole set distance, the user U performs the resistance training exercise with maximum effort and maximum push speed.

The method 60 comprises a step of (c4) determining 68, by the data processing unit 31 (41), a third value of power peak VP3 generated by the user when performing the resistance training exercise by pushing the third push load WS3 over the set distance D1.

For example, again in the case of a sled training exercise performed on a treadmill, once the third push load WS3 is set, the data processing unit 31 (41) knows the resistant torque (force) applied by the user to oppose the resistance represented by the third push load WS3.

Therefore, once the third push load WS3 is known and the advancement speed of the physical exercise surface 13 is determined (measured directly or determined from the rotation speed of at least one of the first rotating element 11 or the second rotating element 12 or of the actuation device 30, the latter measured by an encoder, for example), the third value of power peak VP3 is determined, by the data processing unit 31 (41), by multiplying the third push load value WS3 (set third percentage P3 of the body weight W1 of the user U) for the peak value of the determined advancement speed of the physical exercise surface 13. The peak value of the advancement speed of the physical exercise surface 13 is the maximum value among those determined (for example, at sampling time instants) during the sled training exercise.

The method 60 comprises a step of (d1) determining 69, by the data processing unit 31 (41), an estimated maximum power value VS generatable by a user U during a resistance training exercise on the exercise machine 100 based on the determined first value of power peak VP1, the determined second value of power peak VP2, and the determined third value of power peak VP3.

The method 60 further comprises a symbolic step of ending ED.

In an embodiment, in combination with any one of those described above and shown with dashed lines in FIG. 6, the step of (d1) determining 69 comprises a step of (d2) determining 70, based on a first pair of coordinates (x1, y1) of the determined first value of power peak VP1, on a second pair of coordinates (x2, y2) of the determined second value of power peak VP2, and on a third pair of coordinates (x3, y3) of the determined third value of power peak VP3, coefficients a and b of a mathematical function.

Such a mathematical function can be represented on a graph having on a vertical axis of ordinates y, values of power peaks, and on a horizontal axis of abscissas x, values of resistant torque (force) applied by a user U in opposition to the resistance represented by a set push load (set percentage of the body weight W1 of the user U).

For example, such a mathematical function is representative of a parabola.

Therefore, in such a case, the mathematical function is: $y=ax^2+bx$, where:

y=values of power peak VP;

x=resistant torque (force) applied by a user in opposition to the resistance represented by a set push load (set percentage of the body weight W1 of the user U);

a and b are coefficients of the parabola.

It should be noted that the step of (d2) determining 70 is performed by applying a mathematical model of least squares regression (known per se in the literature), for example.

In the embodiment just described, the step of (d1) determining 69 further comprises a step of (d3) determining 71 the pair of coordinates xV, yV of the vertex point of the mathematical function based on the determined coefficients a and b.

The ordinate value of the pair of coordinates xV, yV of the vertex point of the mathematical function represents the estimated maximum power value VS generatable by a user U during a resistance training exercise.

For example, if the mathematical function is a parabola, the pair of coordinates xV, yV of the vertex point of the parabola can be determined as follows:

$$xV=-b/(2a);$$

$$yV=(b^2)/4a$$

The ordinate value yV represents the estimated maximum power value VS generatable by a user U during a resistance training exercise.

In accordance with an embodiment, in combination with any one of those described above, the method 60, between step (c4) and step (d1), for performing an i-th push training exercise, for 4<i<N, with N being an integer, comprises steps of:

based on a determined push load value $W_{i-1}$;

(e1) comparing 72, by the data processing unit 31 (41), the measured value of power peak $VP_{i-1}$ with each of the previously measured values of power peak $VP_i$, . . . , $VP_{i-2}$;

(e2) determining 73, by the data processing unit 31 (41), a further push load value $WS_i$ based on the result of the step of (e1) comparing 73, the further push load value $WS_i$ corresponding to a set further percentage $P_i$ of the body weight W1 of the user U;

(e3) performing 74, by the user U, the resistance training exercise on the exercise machine (100) by pushing the further push load $WS_i$ equal to the determined value over the set distance D1;

(e4) determining 75, by the data processing unit 31 (41), a further value of power peak $VP_i$ generated by the user U when performing the resistance training exercise by pushing the further push load $WS_i$ over the set distance.

For example, again in the case of a sled training exercise performed on a treadmill, once the further push load $WS_i$ is set, the data processing unit 31 (41) knows the resistant torque (force) applied by the user to oppose the resistance represented by the further push load $WS_i$.

Therefore, once the further push load $WS_i$ is known and the advancement speed of the physical exercise surface 13 is determined (measured directly or determined from the rotation speed of at least one of the first rotating element 11 or the second rotating element 12 or of the actuation device 30, the latter measured by an encoder, for example), the further value of power peak $VP_i$ is determined, by the data processing unit 31 (41), by multiplying the further push load value $WS_i$ (set third percentage P3 of the body weight W1 of the user U) for the peak value of the determined advancement speed of the physical exercise surface 13. The peak value of the advancement speed of the physical exercise surface 13 is the maximum value among those determined (for example, at sampling time instants) during the sled training exercise.

In this embodiment, the step (d1) of determining 69, by the data processing unit 31 (41), the estimated maximum power value VS generatable by a user U during a resistance training exercise on an exercise machine 100 is performed based on the determined first value of power peak VP1, the determined second value of power peak VP2, the determined third value of power peak VP3, and each further determined value of power peak $VP_i$.

In an embodiment, in combination with any one of those described above and shown in FIG. 6 with dashed lines, the method 60 comprises a step of (f1) determining 76, by the data processing unit 31 (41), at least one value x1 of push load WSS or a range of values x1-x2 of push load WSS as a function of the estimated maximum power value VS to be given to the exercise machine 100 for performing the resistance training exercise during a workout of the user U.

Figure 6:
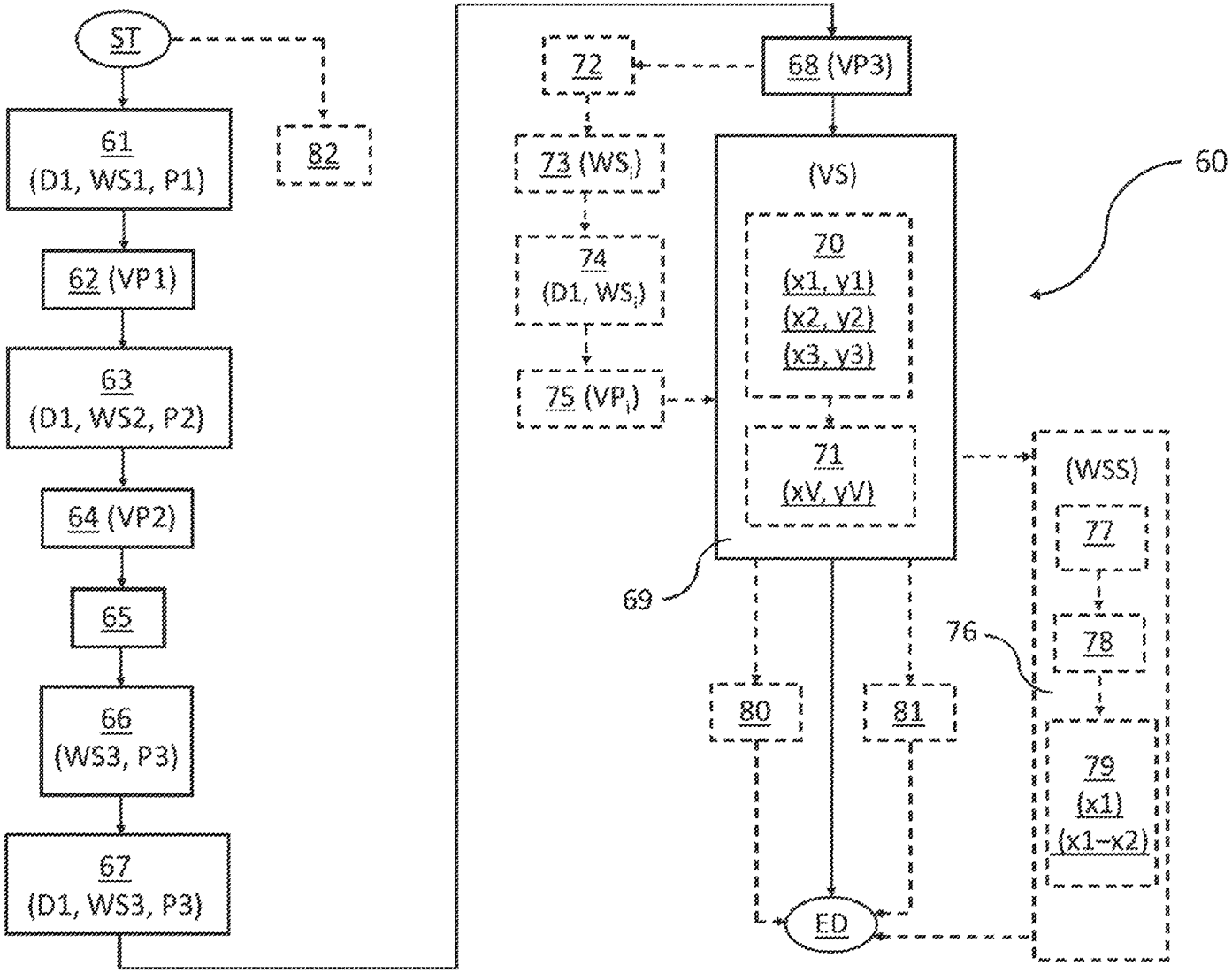
FIG. 6 shows, by means of a block diagram, a method for estimating a maximum power value generatable by a user during a resistance training exercise on an exercise machine, according to an embodiment of the present invention.

In accordance with an embodiment, shown with dashed lines in FIG. 6, the step of (f1) determining 76 comprises the steps of:

(g1) determining 77, based on the ordinate value yV representative of the estimated maximum power value VS generatable by a user U during a resistance training exercise, one or more set values of ordinate y corresponding to a set percentage of the ordinate value yV representative of the estimated maximum power value VS generatable by a user U during a resistance training exercise (for example, y=90% yV);

(g2) locating 78, on the mathematical function graph, one or more values of abscissas x corresponding to said one or more values of ordinates y determined in the previous step;

(g3) determining 79, based on said one or more determined set values of ordinate y and determined coefficients a and b of the mathematical function, values of abscissas x representative of said at least one value x1 of push load WSS or a range of values x1-x2 of push load WWS.

In accordance with an embodiment, in combination with any one of those described above and shown with dashed lines in FIG. 6, the method 60 comprises a step of (h1) providing 80 the user U, by the data processing unit 31 (41) through a display module 34 of the exercise machine 100, with a plurality of information representative of the execution of the resistance training exercise from the method 60, including one or more of:

power peak;

push load (as body weight percentage) (at the parabola vertex) or range of push load values (as body weight percentage);

speed achieved at the power peak.

In accordance with an embodiment, in combination with any one of those described above and shown with dashed lines in FIG. 6, the method 60 comprises a step of (i1) storing 81 in a memory unit 42 of a remote electronic calculator 40, by the data processing unit 31 (41), a plurality of information PI-U representative of the user U at the end of the execution of the method 60.

Such a plurality of information PI-U comprises:

the coordinate xV representative of the push load of the vertex point of the parabola (push load value WSS corresponding to the estimated maximum power value VS);

the coordinate yV representative of the estimated maximum power value VS;

ratio of power peak to body weight or relative power;

push load (as body weight percentage) (at the parabola vertex) or range of push load values (as body weight percentage);

graph comprising the implemented mathematical function (parabola).

In accordance with an embodiment, in combination with any one of those described above and shown with dashed lines in FIG. 6, the method 60 further comprises a step of (11) providing 82 the user U, by the data processing unit 31 (41), with user data D-U stored in a memory unit 42 of a remote electronic calculator 40.

The user data D-U comprise: name and surname, sex, age, body weight, current date.

In accordance with an embodiment, in combination with any one of those described above, the steps of the method 60 performed by the data processing unit are performed by a data processing unit 31 of the exercise machine 100 or a data processing unit 41 of a remote electronic calculator 40 operatively connected to the exercise machine 100 through a data communication network NTW.

In accordance with a further embodiment, alternative to the previous ones, the steps of the method 60 performed by the data processing unit are performed in part by a data processing unit 31 of the exercise machine 100 and in part by a data processing unit 41 of a remote electronic calculator 40 operatively connected to the exercise machine 100 through a data communication network NTW.

Referring now to the above figures, an example of implementation of the method for estimating a maximum power value generatable by a user U during a resistance training exercise on an exercise machine 100 is described, in accordance with the present invention.

For example, the resistance training exercise is a sled training exercise like that diagrammatically shown in FIG. 1, and for example, the exercise machine 100 is a treadmill as in FIG. 1.

The treadmill 100 is set to operate in the "passive" mode with constant torque control.

The user U performs a sled training exercise on the treadmill 100 by pushing a first push load C1, the value of which corresponds to a set first percentage P1 (e.g., 50%) of the body weight W1 of the user U, over a set distance D1, such as 15 m, for example.

Over the whole set distance, the user U performs the sled training exercise with maximum effort and maximum push speed.

A data processing unit 31 of the treadmill 100 measures a first value of power peak VP1 generated by the user U when performing the sled training exercise by pushing the first push load WS1 over the set distance.

The user U performs a recovery exercise (running/walking) on the treadmill for three minutes. For this recovery exercise, the treadmill 100 is set to operate in the so-called "active" mode.

The treadmill 100 is set again to the "passive" mode with constant torque control and the user U performs the sled training exercise on the treadmill 100 by pushing a second push load WS2, the value of which corresponds to a set second percentage P2 (e.g., 80%) of the body weight W1 of the user U, over the set distance.

Over the whole set distance, the user U performs the resistance training exercise with maximum effort and maximum push speed.

The data processing unit 31 of the treadmill 100 measures a second value of power peak VP2 generated by the user U when performing the resistance training exercise by pushing the second push load WS2 over the set distance.

The data processing unit 31 of the treadmill 100 compares the first measured value of power peak VP1 with the second measured value of power peak VP2.

The data processing unit 31 of the treadmill 100 determines a value of a third push load WS3, which value corresponds to a set third percentage P3 of the body weight W1 of the user U, based on the comparison of the first measured value of power peak VP1 with the second measured value of power peak VP2.

For example, in the present case, if VP2>VP1, then WS3=100% W1.

The user U performs the recovery exercise (running/walking) on the treadmill for three minutes. For this recovery exercise, the treadmill 100 is set to operate in the so-called "active" mode.

The treadmill 100 is set again to the "passive" mode with constant torque control and the user U performs the sled training exercise on the exercise machine 100 by pushing the third push load WS3 equal to the determined value over the set distance.

Over the whole set distance, the user U performs the resistance training exercise with maximum effort and maximum push speed.

The data processing unit 31 of the treadmill 100 measures a third value of power peak VP3 generated by the user U when performing the sled training exercise by pushing the third push load WS3 over the set distance.

The data processing unit 31 of the treadmill 100 determines an estimated maximum power value VS generatable by a user U during a sled training exercise on an exercise machine 100 based on the first measured value of power peak VP1, the second measured value of power peak VP2, and the third measured value of power peak VP3.

The data processing unit 31 of the treadmill 100 determines a push load value WSS corresponding to the estimated maximum power value VS to be given to the exercise machine 100 for performing the resistance training exercise during the workout of the user U.

The data processing unit of the treadmill 100 provides the user with the push load value WSS and the estimated maximum power value VS through a display module 34 of the exercise machine 100.

As can be seen, the object of the invention is fully achieved.

In fact, with the method in accordance with the present invention, the estimated maximum power value generatable by a user during a resistance training exercise is more accurate and reliable as it is determined following the execution of at least three resistance training exercises in which the push load to be set for the third execution of the resistance training exercise depends on the comparison of the last measured power peak value with the power peak values measured during the previous executions of the resistance training exercise.

Such an estimation is even more accurate, thus reliable, when further executions of the resistance training exercise are planned, in which the push load for each subsequent execution, starting from the third one, will be determined based on the comparison of the last measured power peak value with the power peak values measured during the previous executions of the resistance training exercise.

In this embodiment, the more executions of the resistance training exercise are performed by the user, the greater the reliability of the estimated maximum power value generatable by a user during a resistance training exercise.

An accurate, reliable estimated maximum power value generatable by a user during a resistance exercise on an exercise machine allows setting a push load value on the exercise machine such as to allow the user to perform a set resistance training exercise in an optimal and safe manner, increasing the possibility of achieving the expected results in terms of performance and improvement of physical fitness and reducing as much as possible the excessive fatigue, the risk of injury, and so on.

In order to meet contingent needs, those skilled in the art may make changes and adaptations to the embodiments of the method, to the exercise machine, and to the system described above, or can replace elements with other functionally equivalent ones, without departing from the scope of the following claims. Each of the features described as belonging to a possible embodiment can be implemented irrespective of the other embodiments described.

The invention claimed is:

1. A method for estimating a maximum power value generatable by a user during a resistance training exercise on a treadmill, the method comprising:

setting a first push load on the treadmill, the value of the first push load corresponds to a set first percentage of a body weight of the user;

performing, by the user, a resistance training exercise on the treadmill pushing the set first push load for a set distance, the value of which corresponds to a set first percentage of the body weight of the user;

determining, by a data processing unit, a first value of power peak generated by the user during the performance of the resistance training exercise on the treadmill by pushing the first push load for the set distance;

setting a second push load on the treadmill, the value of the second push load corresponds to a set second percentage of the body weight of the user;

performing, by the user, the resistance training exercise on the treadmill pushing the set second push load for a set distance;

determining, by the data processing unit, a second value of power peak generated by the user during the performance of the resistance training exercise by pushing the second push load for the set distance;

comparing, by the data processing unit, the first value of power peak measured with the second value of peak power measured;

determining, by the data processing unit, a value of a third push load, the value of the third push load corresponds to a set third percent of the body weight of the user, based on the comparison of the first value of power peak measured with the second value of peak power measured;

setting the third push load on the treadmill;

performing, by the user, the resistance training exercise on the treadmill pushing the set third push load equal to the determined value for the set distance;

determining, by the data processing unit, a third value of power peak generated by the user during the performance of the resistance training exercise by pushing the third push load for the set distance;

determining, by the data processing unit, a set maximum power value generatable by the user during the resistance training exercise on the treadmill based on the determined first value of power peak, the determined second value of power peak, and the determined third value of power peak;

determining, by the data processing unit, a push load value corresponding to an estimated maximum power value to be given to the treadmill for performing the resistance training exercise during a workout of the user;

setting the determined push load value on the treadmill for performing the resistance training exercise during the workout of the user.

2. The method according to claim 1, comprising determining, by the data processing unit, at least one push load value or a range of push load values as a function of the estimated maximum power value to be set to the treadmill for performing the resistance training exercise during a workout of the user.

3. The method according to claim 2, wherein the step (f1) of determining comprises:

determining, based on the ordinate value representative of the estimated maximum power value generatable by the user (U) during the resistance training exercise, one or more set ordinate values y corresponding to a set percentage of the ordinate value representative of the estimated maximum power value generatable by the user during the resistance training exercise;

locating on a mathematical function graph, one or more abscissa values x corresponding to said one or more ordinates values y determined in the preceding step;

determining, based on said one or more set determined ordinate values y and determined parabola coefficients a and b, abscissa values x representative of said at least one push load WSS value or a range of push load WWS values.

4. The method according to claim 1, wherein the step of determining, by the data processing unit, a set maximum power value generatable by the user comprises:

determining, based on a first pair of coordinates of the determined first value of power peak, on a second pair of coordinates of the determined second value of power peak, and on a third pair of coordinates of the determined third value of power peak, coefficients a and b of a mathematical function;

determining the pair of coordinates of a vertex point of the mathematical function based on the determined coefficients, an ordinate value from the pair of coordinates of the vertex point of the mathematical function representing an estimated value of maximum power generatable by the user during the resistance training exercise.

5. The method according to claim 1, wherein the method, between determining, by the data processing unit, a third value of power peak generated by the user and determining, by the data processing unit, a set maximum power value generatable by the user, before performing an i-th resistance training exercise, for $4<i<N$, with N being an integer, comprises:

based on a determined push load value $WS_{i-1}$:

comparing, by the data processing unit, the measured value of power peak $VP_{i-1}$ with each of the previously measured values of power peak $VP_i$, . . . $VP_{i-2}$;

determining, by the data processing unit, a further push load value $WS_i$ based on of the result of the step of comparing, the further push load value $WS_i$ corresponding to a determined further percentage $P_i$ of the body weight of the user;

performing, by the user, the resistance training exercise on the treadmill by pushing the further push load $WS_i$ equal to the determined value for the set distance;

measuring, by the data processing unit, a further value of power peak $VP_i$ generated by the user during the performance of the resistance training exercise by pushing the further push load $WS_i$ for the set distance;

the step of determining, by the data processing unit, the estimated maximum power value generatable by the user during the resistance training exercise on the treadmill being performed based on the determined first value of power peak, the determined second value of power peak, the determined third value of power peak and on each further determined value of power peak $VP_i$.

6. The method according to claim 1, wherein the steps of the method performed by the data processing unit are performed by a data processing unit of the treadmill or by a data processing unit of a remote electronic calculator operatively connected to the treadmill through a data communication network.

7. The method according to claim 1, wherein the steps of the method performed by the data processing unit are performed in part by a data processing unit of the treadmill and in part by a data processing unit of the remote electronic calculator.

8. A treadmill comprising a base extending along a longitudinal axis, the base comprising:

a first rotating element and a second rotating element adapted to rotate about respective rotation axes transverse to the longitudinal axis of the base of the treadmill;

a physical exercise surface operatively connected to the first rotating element and the second rotating element;

the treadmill comprising:

a frame extending substantially in a vertical direction relative to the base having a shape configured for a user to perform resistance training exercises on the exercise surface;

an actuation device of the exercise surface operatively associated with at least one of said first rotating element and said second rotating element, the actuation device being configured to apply a braking action on at least one of the first rotating element or the second rotating element and consequently on the exercise surface;

a data processing unit operatively connected to the actuation device;

the treadmill being configured to estimate a maximum power value generatable by the user during the resistance training exercise on the treadmill;

the data processing unit being configured to:

determine a first value of power peak generated by the user during the performance of the resistance training exercise by pushing a set first push load for a set distance, the value of the first value of power peak corresponds to a set first distance percentage of a body weight of the user;

determine a second value of power peak generated by the user during the performance of the resistance training exercise by pushing a second push load for a set distance;

compare the first value of power peak measured with the second value of peak power measured;

determine a value of a third push load, the value of the third push load corresponds to a set third percent of the body weight of the user, based on the comparison of the first value of power peak measured with the second value of peak power measured;

determine a third value of power peak generated by the user during the performance of the resistance training exercise by pushing the third push load equal to the determined value of the third push load for the set distance;

determine a set maximum power value generatable by the user during the resistance training exercise on the treadmill based on the determined first value of power peak, the determined second value of power peak, and the determined third value of power peak.

9. A system for estimating a maximum power value generatable by a user during a resistance training exercise on a treadmill, a data processing unit of the system being configured to:

determine a first value of power peak generated by the user during the performance of the resistance training exercise by pushing a first push load for a set distance, the first value of power peak corresponding to a set percentage of a body weight of the user;

determine a second value of power peak generated by the user during the performance of the resistance training exercise by pushing a second push load for a set distance;

compare the first value of power peak measured with the second value of peak power measured;

determine a value of a third push load, the value of the third push load corresponds to a set third percent of the body weight of the user, based on the comparison of the first value of power peak measured with the second value of peak power measured;

determine a third value of power peak generated by the user during the performance of the resistance training exercise by pushing a third push load equal to the determined value of the third push load for the set distance;

determine a set maximum power value generatable by the user during the resistance training exercise on the treadmill based on the determined first value of power peak, the determined second value of power peak, and the determined third value of power peak, the system comprising:

a treadmill usable by the user for performing the resistance training exercise, comprising:

a frame extending substantially in a vertical direction relative to a base of the treadmill, the frame having a shape so that the user can perform resistance training exercises on an exercise surface of the treadmill;

an actuation device of the exercise surface operatively associated with at least one of a first rotating element and second rotating element, the actuation device being configured to apply a braking action on at least one of the first rotating element or the second rotating element and consequently on the exercise surface, the data processing unit being operatively connected to the actuation device;

a remote electronic calculator operatively connected to the treadmill through a data communications network, the remote electronic calculator comprising a data processing unit.

* * * * *